US008932007B2

(12) United States Patent
Khanin et al.

(10) Patent No.: US 8,932,007 B2
(45) Date of Patent: Jan. 13, 2015

(54) AXIAL FLOW GAS TURBINE

(75) Inventors: Alexander Anatolievich Khanin, Moscow (RU); Valery Kostege, Moscow (RU); Anton Sumin, Moscow (RU)

(73) Assignee: Alstom Technology Ltd., Baden (CH)

( * ) Notice: Subject to any disclaimer, the term of this patent is extended or adjusted under 35 U.S.C. 154(b) by 403 days.

(21) Appl. No.: 13/306,006

(22) Filed: Nov. 29, 2011

(65) Prior Publication Data

US 2012/0134778 A1 May 31, 2012

(30) Foreign Application Priority Data

Nov. 29, 2010 (RU) ..... 2010148730

(51) Int. Cl.
*F01D 5/08* (2006.01)
*F01D 5/18* (2006.01)
*F01D 25/12* (2006.01)

(52) U.S. Cl.
CPC ..... *F01D 5/084* (2013.01); *F01D 5/081* (2013.01); *F01D 25/12* (2013.01)
USPC ..... 415/116; 415/178; 416/96 R

(58) Field of Classification Search
USPC ..... 415/115, 116; 416/93 R, 95, 96 R
See application file for complete search history.

(56) References Cited

U.S. PATENT DOCUMENTS 2,656,147 A * 10/1953 Brownhill et al. ..... 416/97 R
2,684,831 A * 7/1954 Grantham ..... 416/97 R
2,977,090 A * 3/1961 McCarty et al. ..... 416/96 R
3,748,060 A * 7/1973 Hugoson et al. ..... 416/92
5,558,496 A 9/1996 Woodmansee et al.
5,593,274 A * 1/1997 Carreno et al. ..... 415/115
5,695,319 A * 12/1997 Matsumoto et al. ..... 416/95
5,755,556 A * 5/1998 Hultgren et al. ..... 416/96 R (Continued)

FOREIGN PATENT DOCUMENTS

EP 0909878 4/1999
EP 0965726 A1 12/1999

(Continued)

OTHER PUBLICATIONS

European Search Report for European Patent Application No. 11 19 0647 mailed on Jul. 9, 2014.

(Continued)

*Primary Examiner* — Edward Look
*Assistant Examiner* — Wayne A Lambert
(74) *Attorney, Agent, or Firm* — Buchanan Ingersoll & Rooney PC

(57) ABSTRACT

An axial flow gas turbine (20) includes a rotor (13) and a stator, and a hot gas path through which hot gas passes. The rotor (13) includes a rotor shaft (15) with axial slots for receiving a plurality of blades (B1-B3) arranged in a series of blade rows, with rotor heat shields (R1, R2) interposed between adjacent blade rows. The rotor shaft (15) is configured to axially conduct a main flow of cooling air along the rotor heat shields (R1, R2) and the lower parts of the blades (B1-B3), and the rotor shaft (15) supplies the interior of the blades (B1-B3) with cooling air (18). Stable and predictable cooling air parameters at any blade row inlet are secured by providing air-tight cooling channels (21), which extend axially through the rotor shaft (15) separate from the main flow of cooling air (17), and supply the blades (B1-B3) with cooling air (18).

8 Claims, 4 Drawing Sheets

(56) References Cited

U.S. PATENT DOCUMENTS

| | | | | |
|---|---|---|---|---|
| 5,795,130 | A * | 8/1998 | Suenaga et al. | 416/95 |
| 5,984,636 | A * | 11/1999 | Fahndrich et al. | 416/96 R |
| 6,000,909 | A * | 12/1999 | Hirokawa et al. | 416/96 R |
| 6,185,924 | B1 | 2/2001 | Matsumoto et al. | |
| 6,443,694 | B1 * | 9/2002 | Karlsson | 415/115 |
| 6,506,021 | B1 * | 1/2003 | Wilson et al. | 416/96 R |
| 6,860,110 | B2 | 3/2005 | Akiyama et al. | |
| 7,029,236 | B2 * | 4/2006 | Marushima et al. | 416/96 A |
| 2001/0010797 | A1 * | 8/2001 | Li | 415/115 |
| 2001/0022934 | A1 * | 9/2001 | Mashey | 416/96 R |
| 2002/0025250 | A1 * | 2/2002 | Li | 415/115 |
| 2002/0150467 | A1 * | 10/2002 | Tanioka | 415/115 |
| 2003/0133786 | A1 * | 7/2003 | Uematsu et al. | 415/115 |
| 2003/0143065 | A1 * | 7/2003 | Takahashi et al. | 415/115 |
| 2004/0042896 | A1 | 3/2004 | Akiyama et al. | |
| 2004/0161335 | A1 * | 8/2004 | Marushima et al. | 415/115 |
| 2009/0274552 | A1 * | 11/2009 | Konter et al. | 415/173.1 |
| 2010/0239430 | A1 * | 9/2010 | Gupta | 416/97 R |

FOREIGN PATENT DOCUMENTS

| | | | |
|---|---|---|---|
| EP | 1098067 | | 5/2001 |
| GB | 000789197 | A * | 1/1958 |
| JP | 2001123802 | A | 5/2001 |
| JP | 2010163921 | A | 7/2010 |
| RU | 2182976 | C2 | 5/2002 |

OTHER PUBLICATIONS

Chinese Office Action for Application No. 201110405180.8 dated Jul. 18, 2014.

English Translations of Chinese Office Action for Application No. 201110405180.8 dated Jul. 18, 2014.

Decision to Grant Russian Patent Application No. 2010148730/06(070383) dated Aug. 20, 2014 (Russian).

Decision to Grant Russian Patent Application No. 2010148730/06(070383) dated Aug. 20, 2014 (English).

Examination Report for Application No. GC 2011-19817 issued by the Patent Office of the Cooperation Council for the Arab States of the Gulf dated Oct. 20, 2010.

Japanese Office Action for Patent Application No. 2011-260779 issued on Sep. 16, 2014 (and English translation of this Office Action).

* cited by examiner

AXIAL FLOW GAS TURBINE

This application claims priority under 35 U.S.C. §119 to Russian Federation application no. 2010148730, filed 29 Nov. 2010, the entirety of which is incorporated by reference herein.

BACKGROUND

1. Field of Endeavor

The present invention relates to the technology of gas turbines, and more specifically to a gas turbine of the axial flow type.

2. Brief Description of the Related Art

A gas turbine is composed of a stator and a rotor. The stator constitutes a casing with stator heat shields and vanes installed in it. The turbine rotor, arranged coaxially within the stator casing, includes a rotating shaft with axial slots of fir-tree type used to install blades. Several blade rows and rotor heat shields are installed therein, alternating. Hot gas formed in a combustion chamber passes through profiled channels between the vanes, and, when striking against the blades, makes the turbine rotor rotate.

For the gas turbine to operate with a sufficient efficiency it is essential to work with a very high hot gas temperature. Accordingly, the components of the hot gas channel, especially the blades, vanes and heat shields, of the turbine experience a very high thermal load. Furthermore, the blades are at the same time subject to a very high mechanical stress caused by the centrifugal forces at high rotational speeds of the rotor.

Therefore, it is of essential importance to cool the thermally loaded components of the hot gas channel of the gas turbine.

In the prior art, it has been proposed to provide channels for a blade cooling medium within the rotor shaft itself (see for example EP 909 878 A2 or EP 1 098 067 A2 or U.S. Pat. No. 6,860,110 B2). However, such a cooling configuration requires the complex and costly machining of the rotor or rotor disks.

A different cooling scheme according to the prior art is shown in FIG. 1. The gas turbine 10 of FIG. 1 includes a plurality of stages the first three of which are shown in the Figure. The gas turbine 10 includes a rotor 13, which rotates around a central machine axis, not shown. The rotor 13 has a rotor shaft 15 with axial slots of the fir-tree type used to install a plurality of blades B1, B2 and B3. The blades B1, B2 and B3 of FIG. 1 are arranged in three blade rows. Interposed between adjacent blade rows are rotor heat shields R1 and R2. The blades B1, B2, B3 and the rotor heat shields are evenly distributed around the circumference of the rotor shaft 15. Each of the blades B1, B2 and B3 has an inner platform, which—together with the respective platforms of the other blades of the same row—constitutes a closed ring around the machine axis.

The inner platforms of blades B1, B2 and B3 in combination with the rotor heat shields R1 and R2 form an inner outline of the turbine flow path or hot gas path 12. At the outer side, the hot gas path 12 is bordered by the surrounding stator 11 with its stator heat shields 51, S2 and S3 and vanes V1, V2 and V3. The inner outline separates a rotor cooling air transit cavity, which conducts a main flow of cooling air 17, from the hot gas flow within the hot gas path 12. To improve tightness of the cooling air flow path, sealing plates 19 are installed between adjacent blades B1-B3 and rotor heat shields R1, R2.

As can be seen from FIG. 1, air cools the rotor shaft 15 when flowing in the axial direction along the common flow path between blade necks of blades B1-B3 and rotor heat shields R1, R2; this air passes consecutively through the inner cavity of the blade B1, then in turn through blade B2 and blade B3 cavities.

However, blades contained in modern turbines operate under heavier conditions than vanes because they are, in addition to the effects of high temperatures and gas forces, subject to loads caused by centrifugal forces. To create an efficient blade having large life span, one should solve an intricate complex technical problem.

To solve this problem successfully, one should know the cooling air pressure at the blade inner cavity inlet as precisely as possible. Therefore a serious shortcoming of the rotor design presented in FIG. 1 is that the cooling air pressure loss increases in an unpredictable way as this air passes from the first stage blade B1 to the third stage blade B3. This is caused by air leakages into the turbine flow path 12 through slits between adjacent blades and rotor heat shields. This disadvantage prevents effectively cooled blades from being designed since total cross section area of the above-mentioned slits depends on a scatter of part manufacturing tolerances and on doubtful effectiveness of sealing plates 19.

SUMMARY

One of numerous aspects of the present invention includes a gas turbine which can eliminate the aforementioned shortcomings and secures in a simple way stable and predictable cooling air parameters at any blade row inlet.

A gas turbine embodying principles of the present invention is of the axial flow type and comprises a rotor and a stator, which stator constitutes a casing surrounding the rotor, thereby providing a hot gas path, through which hot gas formed in a combustion chamber passes, whereby the rotor comprises a rotor shaft with axial slots, especially of the fir-tree type, for receiving a plurality of blades, which are arranged in a series of blade rows, with rotor heat shields interposed between adjacent blade rows, thereby forming an inner outline of the hot gas path, and whereby the rotor shaft is configured to conduct a main flow of cooling air in an axial direction along the rotor heat shields and the lower parts of the blades, and whereby the rotor shaft supplies the blades with cooling air entering the interior of the blades.

According to another aspect, air-tight cooling channels are provided which extend axially through the rotor shaft separate from the main flow of cooling air, and supply the blades with cooling air.

According to an exemplary embodiment, the stator comprises a vane carrier, wherein stator heat shields and vanes are installed, with the stator heat shields lying opposite to the blades and the vanes lying opposite to the rotor heat shields.

According to another exemplary embodiment, each blade row comprises the same definite number of blades in the same angular arrangement, and there is at least one air-tight cooling channel provided for one angular blade position of the blade rows, which air-tight cooling channel extends through the respective blades of all blade rows being arranged at the same angular position.

According to another exemplary embodiment, the air-tight cooling channels are established by coaxial cylindrical openings passing in the axial direction through the rotor heat shields and the lower parts of the blades, and by sleeves, which connect the openings of adjacent blades and rotor heat shields in an air-tight fashion.

Especially, air-tight cooling channels are closed at their ends by a plug.

According to another exemplary embodiment, the connecting sleeves are configured to allow a relative displacement of the parts being connected without losing air-tightness of the connection.

Especially, the connecting sleeves have at each end a spherical section on their outside, which allows the swiveling of the sleeves within a cylindrical opening similar to a ball joint.

According to another exemplary embodiment, the connecting sleeves are of reduced mass without sacrificing their stiffness by providing a plurality of circumferentially distributed axial ribs.

The axial ribs may be provided at the inner side of the connecting sleeves.

Alternatively, the axial ribs may be provided at the outer side of the connecting sleeves, whereby the radial height of the ribs is smaller than the radial height of the spherical sections.

BRIEF DESCRIPTION OF THE DRAWINGS

The present invention is now to be explained more closely by means of different embodiments and with reference to the attached drawings.

DETAILED DESCRIPTION OF EXEMPLARY EMBODIMENTS

Figure 1:
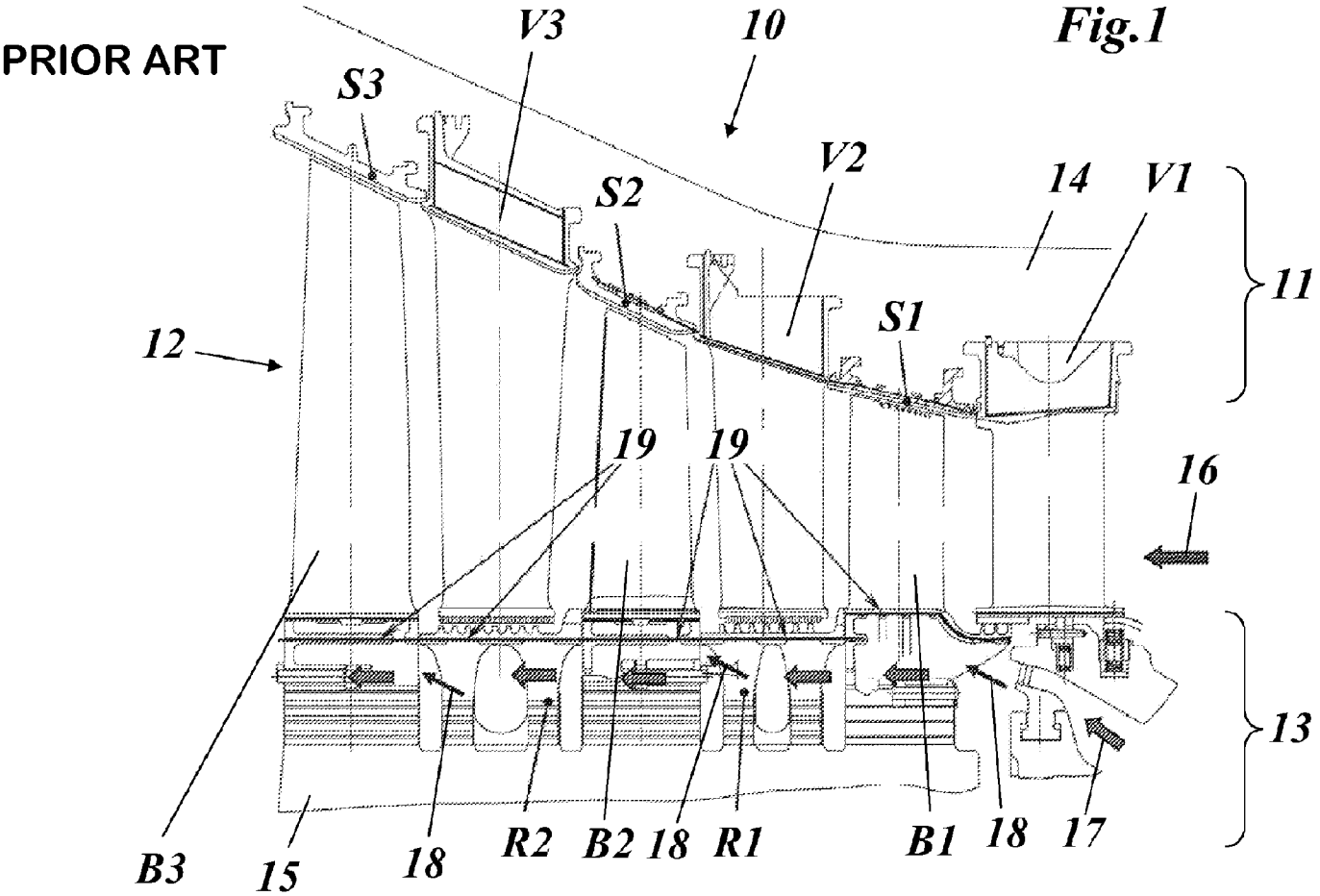
Fig.1 PRIOR ART
FIG. 1 shows the first three stages of a known gas turbine, wherein the cooling air entering the blades is directly taken from the main flow of cooling air flowing along the rotor shaft.
Figure 2:
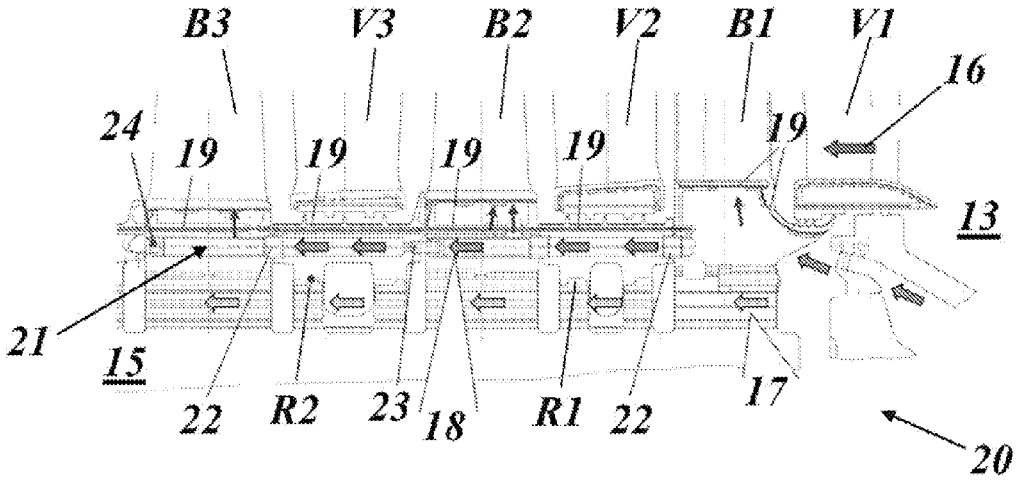
FIG. 2 shows, in a drawing, which is equivalent to FIG. 1, a blade cooling configuration according to an embodiment of the invention.
Figure 3:
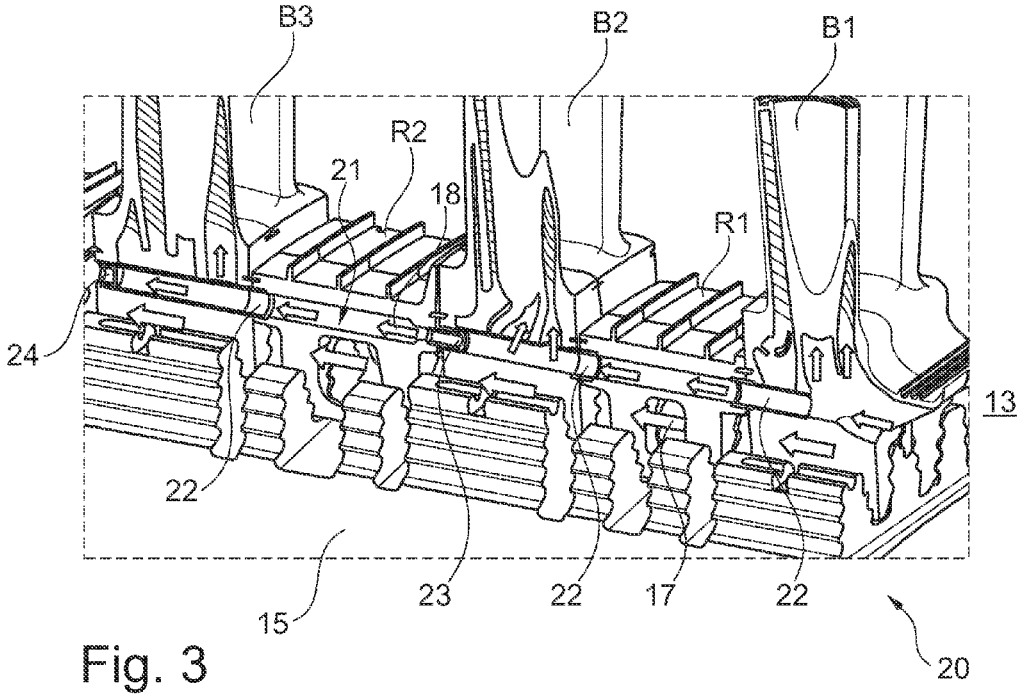
FIG. 3 shows a perspective picture of the blade cooling configuration according to FIG. 2.

FIG. 2 and FIG. 3 show a gas turbine with a blade cooling configuration according to an exemplary embodiment of the invention. The gas turbine 20 of FIG. 2 includes a plurality of stages, the first three of which are shown in the Figure. Similar to FIG. 1, the gas turbine 20 includes a rotor 13 with a rotor shaft 15 and the blades B1, B2 and B3. The blades B1, B2 and B3 are again arranged in three blade rows. Interposed between adjacent blade rows are rotor heat shields R1 and R2. The blades B1, B2, B3 and the rotor heat shields are evenly distributed around the circumference of the rotor shaft 15. Each of the blades B1, B2 and B3 has an inner platform, which—together with the respective platforms of the other blades of the same row—constitutes a closed ring around the machine axis.

The inner platforms of blades B1, B2 and B3, in combination with the rotor heat shields R1 and R2, form an inner outline of the turbine flow path or hot gas path 12. Opposite to the rotor heat shields R1 and R2 are rows of vanes V2 and V3. A first row of vanes V1 is arranged at the entrance of the hot gas path, which is entered by the hot gas 16. The inner outline separates a rotor cooling air transit cavity, which again conducts a main flow of cooling air 17, from the hot gas flow within the hot gas path 12. To improve tightness of the cooling air flow path, sealing plates 19 are installed between adjacent blades B1-B3 and rotor heat shields R1, R2.

The basic difference and advantage of the proposed design according to FIG. 2 is the availability of air-tight cooling channels 21 separated from the main cooling air flow 17 passing along the shaft 15. The number of these cooling channels 21 corresponds to the number of blades B1, B2 and B3 in the circumferential direction in each of the blade rows. For this reason, the number of blades and the circumferential distribution of the blades is the same in each turbine stage or blade row (see FIGS. 6 and 7).

The cooling channels 21 are used to separately supply the blades B1, B2 and B3 with cooling air. They are formed by providing coaxial cylindrical openings 28 passing through the blade B1, rotor heat shield R1, blade B2, rotor heat shield R2, and blade B3. Each channel 21 is terminated with a plug 24 mounted at the end of the corresponding opening 28 of blade B3. Air-tightness of channels 21 is reached by cylindrical sleeves 22, 23 (see FIGS. 4, 5), which are each installed with one of its ends in a recess of a corresponding blade, and—with its other end—in a recess of the corresponding adjacent rotor heat shield. The sleeves 22, 23 are shaped so that they do not prevent adjacent parts from mutual radial and axial displacements (see FIG. 4).

The openings 28 in blades B1-B3 and rotor heat shields R1, R2 are cylindrical. They are shaped so to provide minimum clearance within the contact zone between the recess and the cylindrical sleeves 22, 23 by machining. Thus, both overflow and mixing between main flow 17 and the flow in a channel 21 are prevented by a nearly zero clearance within the contact zones between sleeves 22, 23 on the one side, and blades B1-B3 and rotor heat shields R1, R2 on the another side.

Taking into consideration the above, the following advantages of the proposed design can be recognized:

1. No air leakages from blade cooling air supply channels 21 into the turbine flow path 12.

2. Air from supplying channel 21 does not leak away and does not mix with the main cooling air flow 17 passing along the rotor shaft 15.

3. There is a possibility for having influence on parameters of the cooling air supply for the blades B1-B3 through variation of the inner diameter of the sleeves 22, 23.

Figure 5:
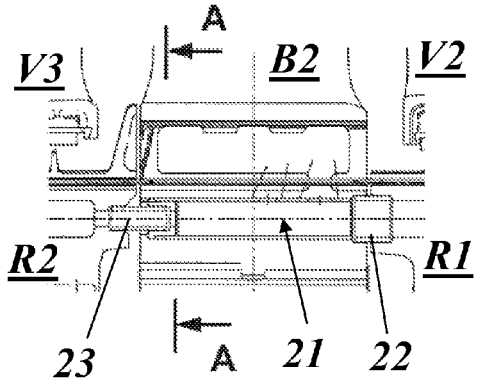
FIG. 5 shows, in a reduced version of FIG. 4, the cutting plane A-A, along which the cross sections of FIG. 6 and FIG. 7 have been taken.
Figure 6:
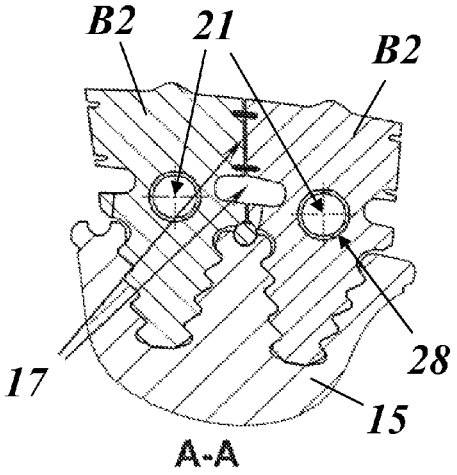
FIG. 6 shows a first cross section along the cutting plane A-A in FIG. 5.
Figure 7:
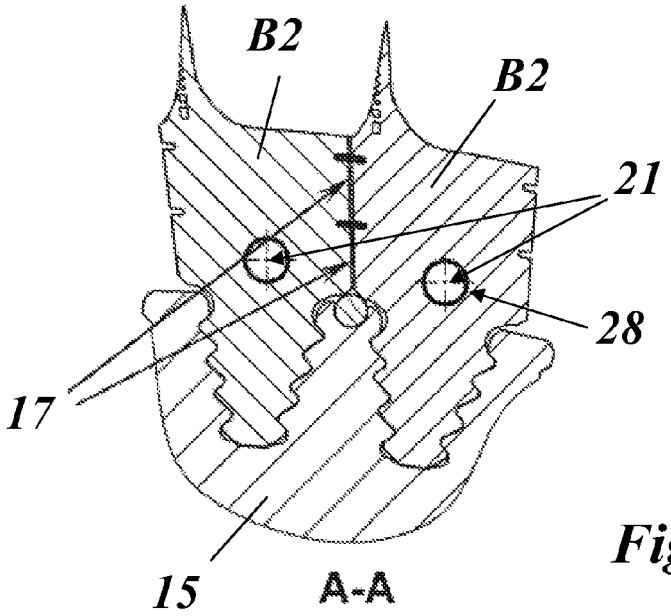
FIG. 7 shows a second cross section along the cutting plane A-A in FIG. 5.

4. There is a possibility for having influence on the thermal state of the rotor shaft 15 due to control over air mass flow passing between blade necks of blades B1-B3 and the rotor heat shields R1, R2 (i.e., the main flow 17, see FIG. 2) regardless of intensity of the air flow passing along the blade supply channel 21. Adjustment of the main air flow 17 can be implemented due to variation of both blade necks and rotor heat shield geometry in any blade row or ring of rotor heat shields (see FIGS. 5-7, where FIG. 6 shows maximum area for the main flow 17 of cooling air and FIG. 7 shows minimum area for the main flow 17 of cooling air).

Thus, the combination of blades B1-B3 and rotor heat shields R1, R2 with through channels (openings 28) and with sealing sleeves 22, 23 allows a modern high performance gas turbine to be created.

The proposed rotor design with longitudinal cooling air supply to blades B1-B3 through a separate channel 21 according to FIG. 2 has also an advantage as compared with the typical known design (FIG. 1) because, with regard to point 4 above, it can be even used without mounting the sleeves 22, 23.

Figure 4:
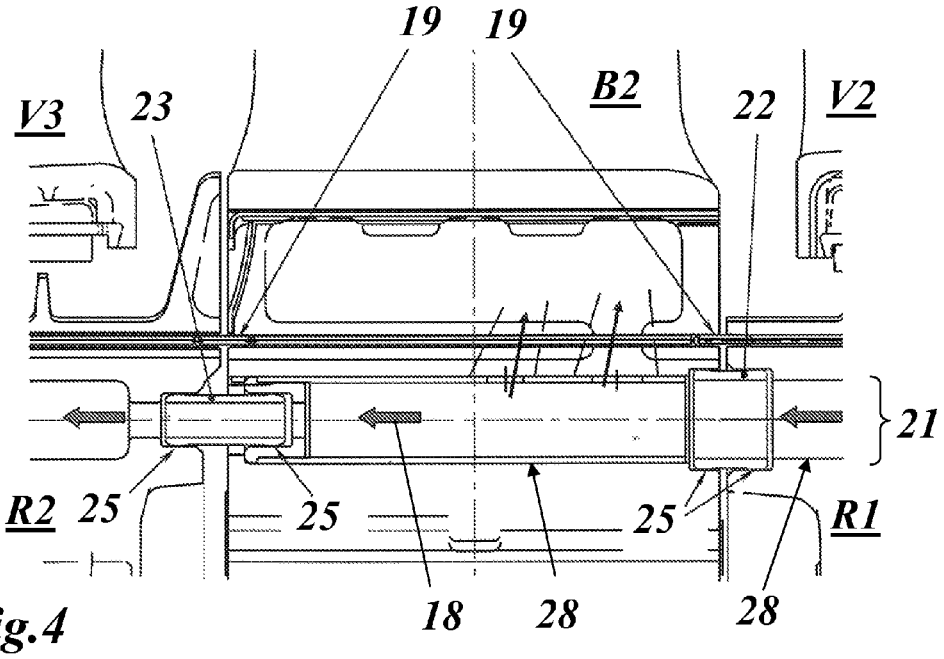
FIG. 4 shows a magnified detail of the blade cooling configuration according to FIG. 2.

FIG. 4 shows embodiments of sleeves, which provide a way for organization of a nearly air-tight channel 21 for cooling air transportation between the rotor parts.

Tightness of the channel 21 is attained by cylindrically shaped sockets made at the ends of openings 28 in adjacent rotor heat shields and blades. The cylindrical shape of the sockets has been chosen because such a socket can be manufactured by machining with high accuracy in the simplest manner.

When sockets made in adjacent parts are mutually displaced due to manufacturing inaccuracy or because of thermal displacements of the rotor heat shields and blades during turbine operation, spherical sections 25 at both ends of the sleeves 22, 23 make it possible to keep the channels 21 air-tight even when the sockets go out of alignment in both circumferential and radial directions. The spherical sections 25 at the ends of the sleeves 22, 23 can also be machined with high accuracy.

Figure 8:
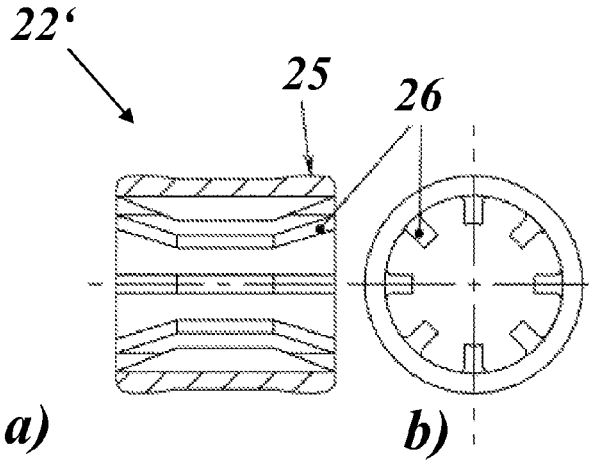
FIG. 8 shows two different views (a) and (b) of a first embodiment of the sleeve according to FIG. 2-5.
Figure 9:
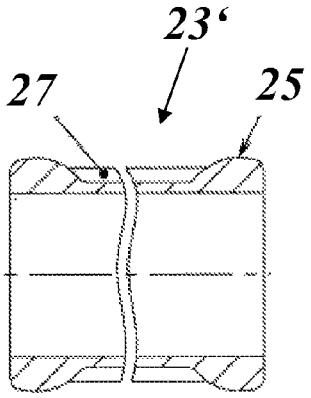
FIG. 9 shows a cross-sectional view of a second embodiment of the sleeve according to FIG. 2-5.

As distinct from stator parts of such type, the sleeves 22, 23 are subject to high centrifugal forces during turbine operation. Therefore it is advisable to reduce their weight since otherwise the respective sockets may be worn out gradually when being in contact with other parts during operation. To either reduce the weight without reducing stiffness or improve stiffness without increasing the weight, stiffness ribs may be provided at those sleeves. According to FIG. 8, those ribs 26 may be provided on the inner surface of the sleeves 22'. According to FIG. 9, such ribs 27 can be also arranged on the outer surface of the sleeves 23'. In this case the spherical sections 25 should have a greater radial height than the ribs 27.

Merits of the proposed design may be summarized once again:

1. Freedom from air leaks out of blade supply channels into the turbine flow path.

2. No leaks and no mixing between that air which is fed into the channel with main cooling air flow passing along the rotor.

3. Through area of the cooling air transportation channel can be adjusted due to variation of inner diameters of the connecting sleeves.

4. The proposed sleeve design allows cooling air leaks to be reduced, and turbine efficiency to be improved.

List of Reference Numerals

10,20 gas turbine
11 stator
12 hot gas path
13 rotor
14 vane carrier
15 rotor shaft
16 hot gas
17 cooling air (main flow)
18 cooling air (entering blade)
19 sealing plate
21 cooling channel (air-tight)
22,22' sleeve (connecting piece)
23,23' sleeve (connecting piece)
24 plug
25 spherical section
26,27 rib
28 opening (coaxial, cylindrical)
B1-B3 blade
R1,R2 rotor heat shield
S1-S3 stator heat shield
V1-V3 vane While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An axial flow gas turbine comprising:

a rotor and a stator, the stator forming a casing surrounding the rotor and forming a hot gas path through which hot gas formed in a combustion chamber can pass;

wherein the rotor comprises a plurality of blades and a rotor shaft with axial slots configured and arranged to receive said plurality of blades arranged in a series of blade rows, and rotor heat shields interposed between adjacent blade rows, thereby forming an inner outline of the hot gas path, wherein each blade row comprises the same number of blades in the same angular arrangement;

wherein the rotor shaft is configured to conduct a main flow of cooling air in an axial direction along the rotor heat shields and along lower parts of the blades;

wherein the rotor shaft is configured to supply the blades with cooling air entering the interior of the blades; and air-tight cooling channels extending axially through the rotor shaft separate from the main flow of cooling air, the air-tight cooling channels being configured to supply the blades with cooling air, at least one air-tight cooling channel being provided for each angular blade position of the blade rows, which at least one air-tight cooling channel extends through the respective blades of all blade rows which are arranged at said same angular position; and wherein said at least one air-tight cooling channel comprises coaxial cylindrical openings axially passing through the rotor heat shields and lower parts of the blades, and sleeves which connect the openings of adjacent blades and rotor heat shields in an air-tight fashion, wherein the sleeves comprise a plurality of circumferentially distributed axial ribs.

2. An axial flow gas turbine according to claim 1, wherein the axial ribs are positioned at an inner side of the sleeves.

3. An axial flow gas turbine according to claim 1, wherein:

the axial ribs are positioned at an outer side of the sleeves; and a radial height of the axial ribs is smaller than a radial height of the spherical sections.

4. An axial flow gas turbine according to claim 1, wherein the axial slots comprise fir-tree slots.

5. An axial flow gas turbine according to claim 1, wherein the stator comprises a vane carrier in which said stator heat shields and stator vanes are installed, with the stator heat shields lying opposite to the blades and the vanes lying opposite to the rotor heat shields.

6. An axial flow gas turbine according to claim 1, further comprising:

at least one plug closing the at least one air-tight cooling channel at an end of the at least one air-tight cooling channel.

7. An axial flow gas turbine according to claim 1, wherein the sleeves are configured to allow a relative displacement of the parts being connected without losing air-tightness of the connection of the openings of adjacent blades and rotor heat shields.

8. An axial flow gas turbine according to claim 7, wherein the sleeves have ends and an outer spherical section at each end, the spherical section allowing swiveling of the sleeves within a cylindrical opening and forming a ball joint therewith.

* * * * *